US007843390B2

(12) United States Patent
Liu

(10) Patent No.: US 7,843,390 B2
(45) Date of Patent: Nov. 30, 2010

(54) ANTENNA

(75) Inventor: Chih-Kai Liu, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 1104 days.

(21) Appl. No.: 11/524,913

(22) Filed: Sep. 22, 2006

(65) Prior Publication Data

US 2007/0268186 A1 Nov. 22, 2007

(30) Foreign Application Priority Data

May 18, 2006 (TW) ..... 95117726 A

(51) Int. Cl.
*H01Q 1/38* (2006.01)

(52) U.S. Cl. ..... 343/700 MS

(58) Field of Classification Search ..... 343/700 MS, 343/846

See application file for complete search history.

(56) References Cited

U.S. PATENT DOCUMENTS 6,650,294 B2 * 11/2003 Ying et al. ..... 343/700 MS
6,950,069 B2 * 9/2005 Gaucher et al. ..... 343/702
7,026,999 B2 * 4/2006 Umehara et al. ..... 343/702
7,046,196 B1 * 5/2006 Langley et al. ..... 343/700 MS
7,119,743 B2 * 10/2006 Iguchi et al. ..... 343/700 MS
7,319,432 B2 * 1/2008 Andersson ..... 343/702
7,324,050 B2 * 1/2008 Chung et al. ..... 343/700 MS
7,385,556 B2 * 6/2008 Chung et al. ..... 343/700 MS
7,432,860 B2 * 10/2008 Huynh ..... 343/700 MS

FOREIGN PATENT DOCUMENTS

TW 542419 7/2003

* cited by examiner

*Primary Examiner*—Tan Ho
(74) *Attorney, Agent, or Firm*—Rosenberg, Klein & Lee

(57) ABSTRACT

An antenna includes a grounding element, a radiating element, an interconnecting element and a conductive element. The interconnecting element connects the radiating element and the grounding element. The conductive element is disposed between the grounding element and the radiating element and apart from the grounding element and the radiating element. Moreover, the conductive element has a feed positioned thereon.

7 Claims, 3 Drawing Sheets

ANTENNA

RELATED APPLICATIONS

The present application is based on, and claims priority from, Taiwan Application Serial Number 95117726, filed May 18, 2006, the disclosure of which is hereby incorporated by reference herein in its entirety.

BACKGROUND

1. Field of Invention

The present invention relates to an antenna. More particularly, the present invention relates to an antenna which employs a capacitor structure to broaden the band of the antenna.

2. Description of Related Art

As the rapid development of wireless communication technologies, many electronic apparatus, such as mobile phones, computers or network applications, have used wireless communication technologies to communicate with each other, wireless wide area network (WWAN) especially. More and more manufacturers want to incorporate WWAN into consumer electronic products because WWAN can provide communication within a local, nationwide or even global area.

A typical receiving or transmitting wireless communication device includes a receiver or a transmitter and an antenna mounted thereon. The antenna is a terminal that transmits or receives an electromagnetic wave. The antenna should be designed carefully to radiate electromagnetic waves effectively. The antenna seriously affects the performance of the whole wireless network application. Therefore, how to design a standard compatible and useful antenna is very important.

Each wireless communication technology like WWAN has numerous wireless communication standards. Typically, one antenna is compatible with one specific wireless communication standard only due to the narrow band of the antenna. Therefore, in order to be compatible with more wireless communication standards, many manufactures configure two or more antennas with different standards into a consumer electronic product. However, two or more antennas consume a lot of space and interfere with each other.

For the foregoing reasons, there is a need to develop an antenna with a broad band to be compatible with more wireless communication standards for manufacturers, sales and consumers.

SUMMARY

The prior antenna is not compatible with different wireless communication standards. This limits applications of prior antennas. Thus, the prior antenna is unable to satisfy modern requirements any longer.

It is therefore an aspect of the present invention to provide an antenna which employs a capacitor structure to broaden the band of the antenna.

According to one preferred embodiment of the present invention, an antenna includes a grounding element, a radiating element, an interconnecting element and a conductive element. The interconnecting element connects the radiating element and the grounding element. The conductive element is disposed between the grounding element and the radiating element, and the conductive element is positioned apart from the grounding element and the radiating element. Moreover, the conductive element has a feed positioned thereon. The conductive element, the radiating element and the distance therebetween constitute a capacitor structure, which can broaden the band of the antenna when a current is fed into the conductive element through the feed.

In other words, the conductive element is disposed near a surface of the radiating element which faces the grounding element. Similarly, the conductive element, the radiating element and the distance therebetween constitute a capacitor structure, which can broaden the band of the antenna when a current is fed into the conductive element through the feed.

Therefore, the antenna according to the mentioned embodiment of the present invention has a broad band to be compatible with more wireless communication standards. Moreover, the consumer electronic product with the antenna does not necessarily have plural antennas built therein due to the broad band of the antenna, and thus inference between the antennas no longer occurs.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
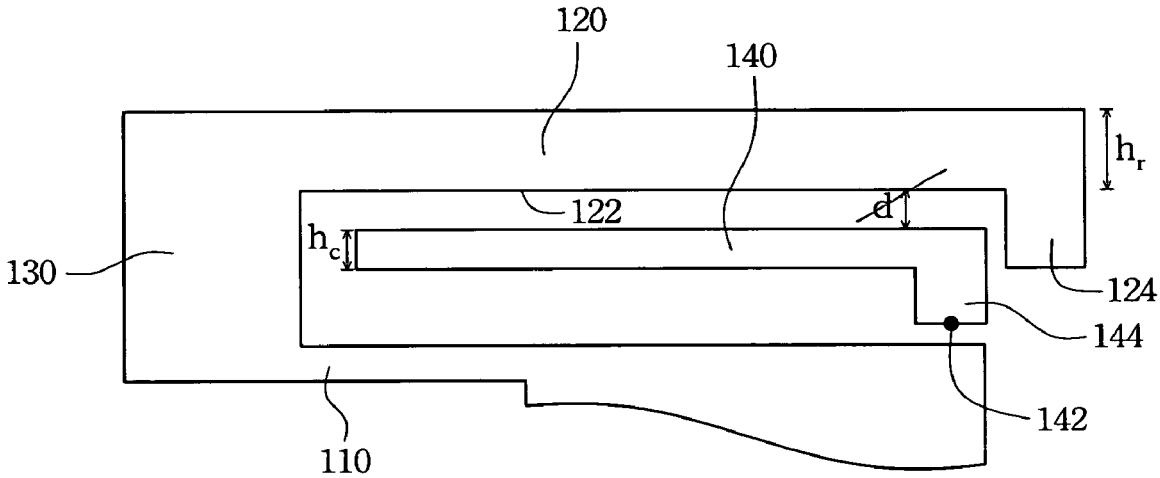
FIG. 1 is a side view of an antenna according to one preferred embodiment of the invention.

The present invention provides an antenna, which employs a capacitor structure constituted by a conductive element and a radiating element to broaden the band of the antenna. Reference will now be made in detail to the present preferred embodiments of the invention, examples of which are illustrated in the accompanying drawings. Wherever possible, the same reference numbers are used in the drawings and the description to refer to the same or like parts.

Reference is made to FIG. 1, which is a side view of an antenna according to one preferred embodiment of the invention. In FIG. 1, an antenna includes a grounding element 110, a radiating element 120, an interconnecting element 130 and a conductive element 140. The interconnecting element 130 connects the radiating element 120 and the grounding element 110. The conductive element 140 is disposed between the grounding element 110 and the radiating element 120, and the conductive element 140 is positioned apart from the grounding element 110 and the radiating element 120. Moreover, the conductive element 140 has a feed 142 positioned thereon. The conductive element 140, the radiating element 120 and the distance d therebetween constitute a capacitor structure, which can broaden the band of the antenna when a current is fed into the conductive element 140 through the feed 142.

In other words, the conductive element 140 is disposed near a surface 122 of the radiating element 120 which faces the grounding element 110. Similarly, the conductive element 140, the radiating element 120 and the distance d therebetween constitute a capacitor structure, which can broaden the band of the antenna when a current is fed into the conductive element 140 through the feed 142.

The conductive element 140 may have a bent part 144 bent towards the grounding element 110, and the feed 142 is positioned on the bent part 144. The bent part 144 can enhance the coupling effect of the antenna for reducing the VSWR, and thus the band of the antenna is broadened. Although the feed 142 is positioned on the bent part 144 in FIG. 1, the feed 142 may be positioned on the other parts of the conductive element 140 as well.

Moreover, the radiating element 120 may also have a bent part 124 bent towards the grounding element 110. Because the consumer electronic products are becoming smaller, the radiating element 120 has the bent part 124 bent towards the grounding element 110, and thus the radiating element 120 with enough length can be configured into the products more easily.

In this embodiment, the width $h_r$ of the radiating element 120 is about twice of the width $h_c$ of the conductive element 140. Furthermore, the conductive element 140 is spaced from the radiating element 120 at a distance d, and the distance d is substantially equal to the width $h_c$ of the conductive element 140. However, the mentioned sizes should not limit the scope of the present invention, and the detail sizes of the antenna should depend on actual requirements.

Figure 2:
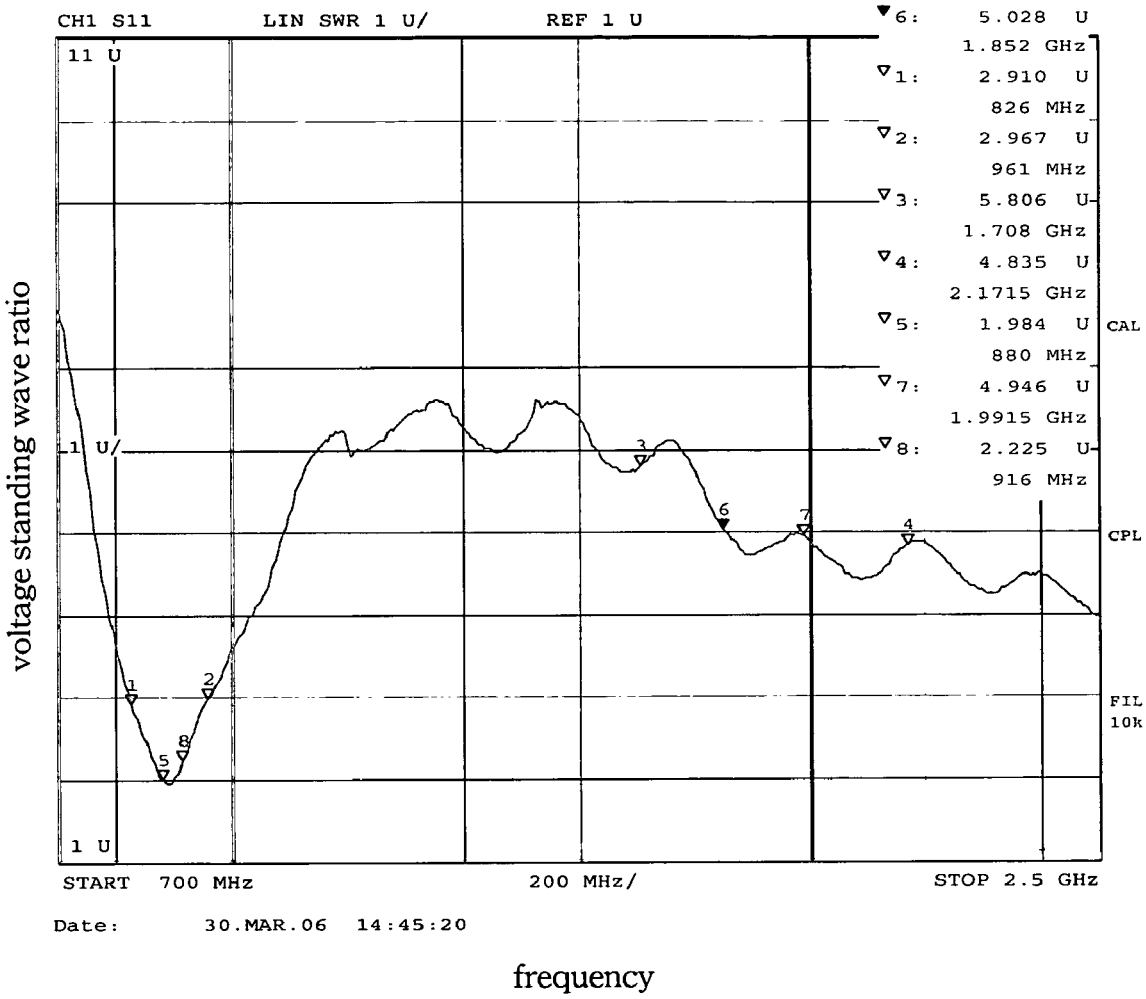
FIG. 2 is a diagram showing a curve of voltage standing wave ratio (VSWR) vs. frequency for a typical planar inverted F antenna (PIFA)
Figure 3:
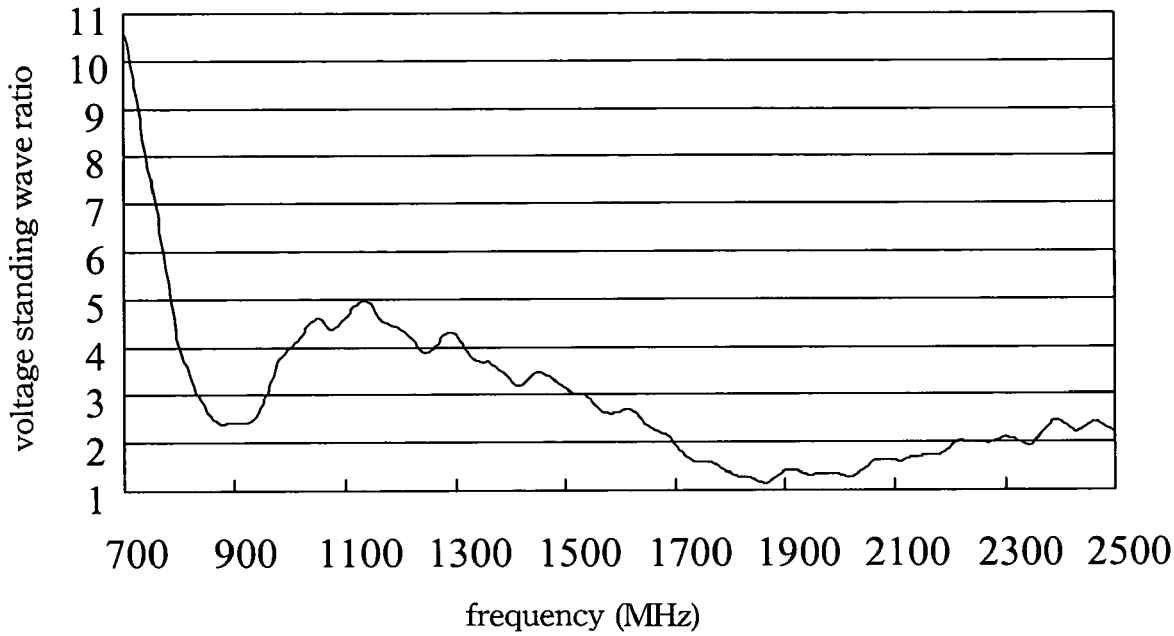
FIG. 3 is a diagram showing a curve of VSWR vs. frequency for the antenna shown in FIG. 1.

Reference is made to FIG. 2 and FIG. 3. FIG. 2 shows a curve of VSWR vs. frequency for a typical PIFA. FIG. 3 shows a curve of VSWR vs. frequency for the antenna shown in FIG. 1. As shown in FIG. 2 and FIG. 3, when the working frequency of the PIFA and the antenna are within 1.8-2.2 GHz, the VSWR of the antenna is lower than the VSWR of the PIFA. Therefore, the antenna according to the mentioned embodiment has a broader band than the PIFA at least in the high frequency part.

In conclusion, the invention has at least the following advantages:

(1) the antenna according to the mentioned embodiment of the invention has a broad band to be compatible with more wireless communication standards; and (2) the consumer electronic products with the antenna does not necessarily have plural antennas built therein due to the broad band of the antenna, and thus inference between the antennas no longer occurs.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna comprising:

a grounding element;

a radiating element, wherein the radiating element has a bent part bent towards the grounding element;

an interconnecting element connecting the grounding element and the radiating element; and a conductive element disposed between the grounding element and the radiating element and apart from the grounding element and the radiating element, wherein the conductive element has a feed positioned thereon.

2. An antenna comprising:

a grounding element;

a radiating element;

an interconnecting element connecting the grounding element and the radiating element; and a conductive element disposed between the grounding element and the radiating element and apart from the grounding element and the radiating element, wherein the conductive element has a feed positioned thereon, wherein the width of the radiating element is about twice of the width of the conductive element.

3. The antenna of claim 2, wherein the radiating element has a bent part bent towards the grounding element.

4. The antenna of claim 2, wherein the conductive element has a bent part bent towards the grounding element, and the feed is positioned on the bent part.

5. An antenna comprising:

a grounding element;

a radiating element;

an interconnecting element connecting the grounding element and the radiating element; and a conductive element disposed between the grounding element and the radiating element and apart from the grounding element and the radiating element, wherein the conductive element has a feed positioned thereon, wherein the conductive element is spaced from the radiating element at a distance, and the distance is substantially equal to the width of the conductive element.

6. The antenna of claim 5, wherein the radiating element has a bent part bent towards the grounding element.

7. The antenna of claim 5, wherein the conductive element has a bent part bent towards the grounding element, and the feed is positioned on the bent part.

* * * * *